US009636797B2

(12) United States Patent
Xu et al.

(10) Patent No.: US 9,636,797 B2
(45) Date of Patent: May 2, 2017

(54) ADJUSTING EDDY CURRENT MEASUREMENTS

(71) Applicant: Applied Materials, Inc., Santa Clara, CA (US)

(72) Inventors: Kun Xu, Sunol, CA (US); Ingemar Carlsson, Milpitas, CA (US); Boguslaw A. Swedek, Cupertino, CA (US); Doyle E. Bennett, Santa Clara, CA (US); Shih-Haur Shen, Sunnyvale, CA (US); Hassan G Iravani, San Jose, CA (US); Wen-Chiang Tu, Mountain View, CA (US); Tzu-Yu Liu, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 537 days.

(21) Appl. No.: 14/179,297

(22) Filed: Feb. 12, 2014

(65) Prior Publication Data

US 2015/0224623 A1 Aug. 13, 2015

(51) Int. Cl.
*B24B 49/10* (2006.01)
*B24B 49/14* (2006.01)
(Continued)

(52) U.S. Cl.
CPC ..... *B24B 49/105* (2013.01); *B24B 37/013* (2013.01); *B24B 49/02* (2013.01); *B24B 49/14* (2013.01)

(58) Field of Classification Search
CPC ..... B24B 37/013; B24B 49/02; B24B 49/105; B24B 49/14; G01B 7/105; H01L 21/67253
(Continued)

(56) References Cited

U.S. PATENT DOCUMENTS 6,724,187 B2 * 4/2004 Nix ..... G01D 3/036 324/225
6,924,641 B1 8/2005 Hanawa et al.
(Continued)

FOREIGN PATENT DOCUMENTS

JP 2009-099842 5/2009
JP 2011-023579 2/2011
(Continued)

OTHER PUBLICATIONS

International Search Report and Written Opinion in International Application No. PCT/US2015/012281, dated Apr. 30, 2015, 5 pages.

*Primary Examiner* — Monica Carter
*Assistant Examiner* — Marcel Dion
(74) *Attorney, Agent, or Firm* — Fish & Richardson P.C.

(57) ABSTRACT

Among other things, a method of controlling polishing during a polishing process is described. The method includes receiving a measurement of a thickness, thick(t), of a conductive layer of a substrate undergoing polishing from an in-situ monitoring system at a time t; receiving a measured temperature, T(t), associated with the conductive layer at the time t; calculating resistivity $\rho_T$ of the conductive layer at the measured temperature T(t); adjusting the measurement of the thickness using the calculated resistivity $\rho_T$ to generate an adjusted measured thickness; and detecting a polishing endpoint or an adjustment for a polishing parameter based on the adjusted measured thickness.

19 Claims, 7 Drawing Sheets

(51) Int. Cl.
*B24B 49/02* (2006.01)
*B24B 37/013* (2012.01)

(58) Field of Classification Search
USPC ..... 451/5, 7, 41, 287, 288
See application file for complete search history.

(56) References Cited

U.S. PATENT DOCUMENTS 7,016,795 B2 * 3/2006 Swedek ..... B24B 37/013 324/228
7,112,960 B2 9/2006 Miller et al.
7,403,001 B1 * 7/2008 Bailey, III ..... G01B 7/105 324/222
2003/0038628 A1 * 2/2003 Nath ..... G01B 7/105 324/230
2005/0048875 A1 * 3/2005 Koo ..... B24B 37/013 451/7
2005/0121141 A1 6/2005 Manens
2006/0214657 A1 9/2006 Tada et al.
2007/0036198 A1 * 2/2007 Brcka ..... G01B 7/105 374/7
2007/0103150 A1 5/2007 Tada et al.
2007/0205765 A1 * 9/2007 Bailey, III ..... G01B 7/105 324/230
2007/0251922 A1 11/2007 Swedek et al.
2009/0023361 A1 * 1/2009 Matsuzaki ..... B24B 49/105 451/5
2009/0104847 A1 * 4/2009 Kobayashi ..... B24B 37/042 451/5
2009/0156098 A1 6/2009 Swedek et al.
2010/0099334 A1 4/2010 Bennett et al.
2010/0120330 A1 5/2010 Zhang et al.
2011/0124269 A1 5/2011 Tada et al.
2011/0318992 A1 12/2011 David et al.
2014/0004626 A1 1/2014 Xu et al.

FOREIGN PATENT DOCUMENTS

KR 10-2005-0024589 3/2005
WO 9721070 6/1997
WO 0146684 6/2001
WO WO 2004/059242 7/2004

* cited by examiner

ADJUSTING EDDY CURRENT MEASUREMENTS

TECHNICAL FIELD

The present disclosure relates to chemical mechanical polishing and more specifically to monitoring of a conductive layer during chemical mechanical polishing.

BACKGROUND

An integrated circuit is typically formed on a substrate by the sequential deposition of conductive, semiconductive, or insulative layers on a silicon wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. Polishing slurry with abrasive particles is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry composition, the polishing pad condition, the relative speed between the polishing pad and the substrate, the initial thickness of the substrate layer, and the load on the substrate can cause variations in the material removal rate. These variations cause variations in the time needed to reach the polishing endpoint. Therefore, determining the polishing endpoint merely as a function of polishing time can lead to non-uniformity within a wafer or from wafer to wafer.

In some systems, a substrate is monitored in-situ during polishing, e.g., through the polishing pad. One monitoring technique is to induce an eddy current in the conductive layer and detect the change in the eddy current as the conductive layer is removed.

SUMMARY

In one aspect, this disclosure features a method of controlling polishing during a polishing process. The method comprises receiving a measurement of a thickness, thick(t), of a conductive layer of a substrate undergoing polishing from an in-situ monitoring system at a time t; receiving a measured temperature, T(t), associated with the conductive layer at the time t; calculating resistivity $\rho_T$ of the conductive layer at the measured temperature T(t); adjusting the measurement of the thickness using the calculated resistivity $\rho_T$ to generate an adjusted measured thickness; and detecting a polishing endpoint or an adjustment for a polishing parameter based on the adjusted measured thickness.

In another aspect, this disclosure also features a computer program product, tangibly encoded on a non-transitory computer readable media, includes instructions operable to cause a data processing apparatus to perform operations to carry out any of the above methods.

In another aspect, this disclosure features a polishing system comprising a rotatable platen to support a polishing pad; a carrier head to hold a substrate against the polishing pad; a temperature sensor; an in-situ eddy current monitoring system including a sensor to generate a eddy current signal depending on a thickness of a conductive layer on the substrate; and a controller. The controller is configured to perform operations comprising receiving a measurement of a thickness, thick(t), of the conductive layer of the substrate undergoing polishing from the in-situ eddy current monitoring system at a time t; receiving a measured temperature, T(t), associated with the conductive layer at the time t; calculating resistivity $\rho_T$ of the conductive layer at the measured temperature T(t); adjusting the measurement of the thickness using the calculated resistivity $\rho_T$ to generate an adjusted measured thickness; and detecting a polishing endpoint or an adjustment for a polishing parameter based on the adjusted measured thickness.

In another aspect, this disclosure features a system comprising a processor; a memory; a display; and a storage device that stores a program for execution by the processor using the memory. The program comprises instructions configured to cause the processor to: display a graphical user interface on the display to a user. The graphical user interface contains activatable options for the user to take to control polishing of a conductive layer during a polishing process. The options comprise a first option for adjusting endpoint determination based on temperature variation of the conductive layer. The program also comprises instructions configured to cause the processor to: receive an indication that the first option is activated by the user; receive a measurement of a thickness, thick(t), of a conductive layer of a substrate undergoing polishing from an in-situ monitoring system at a time t; receive a measured temperature, T(t), associated with the conductive layer at the time t; calculate resistivity $\rho_T$ of the conductive layer at the measured temperature T(t); adjust the measurement of the thickness using the calculated resistivity $\rho_T$ to generate an adjusted measured thickness; and detect a polishing endpoint or an adjustment for a polishing parameter based on the adjusted measured thickness.

Implementations of the methods, the computer program products, and/or the systems may include one or more of the following features. Detecting a polishing endpoint comprises comparing the adjusted measurement of the thickness with a predetermined measurement of thickness for determining whether the polishing process has reached the polishing endpoint. The monitoring system comprises an eddy current monitoring system and the measurement of the thickness comprises an eddy current signal A(t). The eddy current signal A(t) is converted into a measured thickness thick(t) using a signal to thickness correlation equation. Calculating the resistivity $\rho_T$ of the conductive layer comprises calculating the resistivity $\rho_T$ based on: $\rho_T=\rho_0[1+\alpha(T(t)-T_{ini})]$, where $T_{ini}$ is the initial temperature of the conductive layer when the polishing process starts, $\rho_0$ is the resistivity of the conductive layer at $T_{ini}$, and $\alpha$ is the resistivity temperature coefficient of the conductive layer. The measured thickness, thick(t), at the temperature T(t) is determined based on the measurement of the thickness and the measured thickness is adjusted to an adjusted thickness $thick_0(t)$ at $T_{ini}$ using the calculated $\rho_T$. $T_{ini}$ is room temperature. Adjusting the measurement of the thickness comprises converting the adjusted thickness $thick_0(t)$ to a corresponding adjusted eddy current signal. Detecting a polishing endpoint comprises comparing the adjusted eddy current signal with a predetermined eddy current signal to determine whether the polishing process has reached the polishing endpoint. The measured temperature, T(t), is the temperature of the conductive layer at time t. The a measured temperature, T(t), is the temperature of a polishing pad that polishes the conductive layer at time t.

Implementations may include one or more of the following advantages. Possible inaccuracy of the correlation between a measured eddy current signal and a conductive layer thickness caused by temperature variation of the conductive layer can be mitigated. Compensating processes can be automatically carried out in-situ. An adjusted eddy current signal or an adjusted conductive layer thickness using the compensating processes can be more accurate than the measured signal or thickness. The adjusted eddy current signal and/or the adjusted conductive layer can be used for determining control parameters during a polishing process and/or determining an endpoint for the polishing process. Reliability of the control parameter determination and endpoint detection can be improved, wafer under-polish can be avoided, and within-wafer non-uniformity can be reduced.

The details of one or more implementations are set forth in the accompanying drawings and the description below. Other aspects, features, and advantages will be apparent from the description and drawings, and from the claims.

DETAILED DESCRIPTION

Overview

Figure 1:
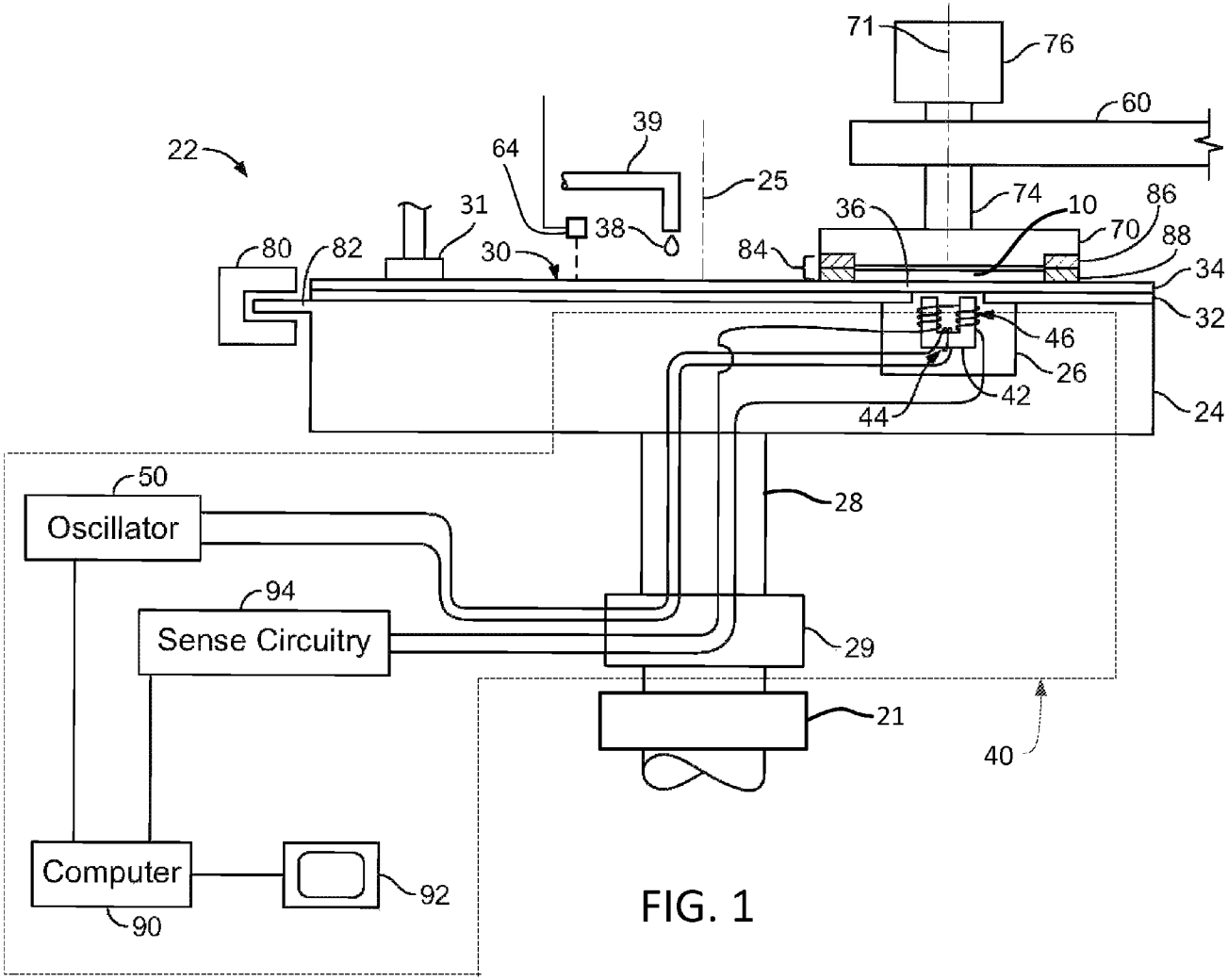
FIG. 1 illustrates a cross-sectional view of an example of a polishing station including an eddy current monitoring system.

One monitoring technique for controlling a polishing operation is to use an alternating current (AC) drive signal to induce eddy currents in a conductive layer on a substrate. The induced eddy currents can be measured by an eddy current sensor in-situ during polishing to generate a signal. Assuming the outermost layer undergoing polishing is a conductive layer, then the signal from the sensor should be dependent on the thickness of the conductive layer.

Different implementations of eddy current monitoring systems may use different aspects of the signal obtained from the sensor. For example, the amplitude of the signal can be a function of the thickness of the conductive layer being polished. Additionally, a phase difference between the AC drive signal and the signal from the sensor can be a function of the thickness of the conductive layer being polished.

Using the eddy current signals, the thickness of the conductive layer can be monitored during the polishing operation. Based on the monitoring, control parameters for the polishing operation, such as polishing rate, can be adjusted in-situ. In addition, the polishing operation can terminate based on an indication that the monitored thickness has reached a desired endpoint thickness.

The accuracy of the correlation between the eddy current signals and the conductive layer thickness may be affected by various factors. One factor is the temperature of the conductive layer. The resistivity of a conductive layer varies as the temperature of the layer varies. With other parameters, such as the composition and assembly of the eddy current system, being the same, the eddy current signals generated from the same conductive layer having the same thickness will be different if the measurements are performed when the conductive layer has different temperatures. As a result, measured thicknesses of the conductive layer having different temperatures from these different eddy current signals are different, while the actual thickness of the conductive layer is constant.

During a polishing operation, the temperature of the conductive layer may increase over time, e.g., due to the friction between a surface of the conductive layer being polished and a polishing surface of a polishing pad that polishes the surface of the conductive layer. In other words, the temperature of the conductive layer can be higher near the endpoint of the polishing operation than at the beginning of the polishing operation. In some situations, a newer polishing pad can have a more abrasive polishing surface than an older polishing pad, and the temperature of the conductive layer may rise at a higher rate when the new pad is used.

Accordingly, the eddy current measurements, including the eddy current signals and the measured thicknesses based on the eddy current signals, are adjusted based on the temperature variation of the conductive layer. Control parameter adjustment and/or endpoint detection based on the adjusted eddy current measurements can be more accurate and more reliable.

In addition, due to composition and assembly variations, eddy current sensors can exhibit different gains and offsets when measuring the eddy current. The eddy current can also be affected by variations in the environmental parameters, e.g., the temperature of the substrate during polishing. Run time variations such as pad wear or variations of the pressure exerted on the polishing pad (e.g., in an in-situ monitoring system) can change the distance between the eddy current sensor and the substrate and can also affect the measured eddy current signal. Therefore, the eddy current monitoring system may be calibrated to compensate for these variations. Details of the calibration related to these gains and offsets are discussed in U.S. Ser. No. 14/066,509, the entire contents of which is incorporated here by reference.

Example Polishing Station

FIG. 1 illustrates an example of a polishing station 22 of a chemical mechanical polishing apparatus. The polishing station 22 includes a rotatable disk-shaped platen 24 on which a polishing pad 30 is situated. The platen 24 is operable to rotate about an axis 25. For example, a motor 21 can turn a drive shaft 28 to rotate the platen 24. The polishing pad 30 can be a two-layer polishing pad with an outer layer 34 and a softer backing layer 32.

The polishing station 22 can include a supply port or a combined supply-rinse arm 39 to dispense a polishing liquid 38, such as slurry, onto the polishing pad 30.

The carrier head 70 is operable to hold a substrate 10 against the polishing pad 30. The carrier head 70 is suspended from a support structure 60, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel or track 60; or by rotational oscillation of the carousel itself. In operation, the platen is rotated about its central axis 25, and the carrier head is rotated about its central axis 71 and translated laterally across the top surface of the polishing pad 30. Where there are multiple carrier heads, each carrier head 70 can have independent control of its polishing parameters, for example each carrier head can independently control the pressure applied to each respective substrate.

The carrier head 70 can include a retaining ring 84 to hold the substrate. In some implementations, the retaining ring 84 may include a highly conductive portion, e.g., the carrier ring can include a thin lower plastic portion 86 that contacts the polishing pad, and a thick upper conductive portion 88. In some implementations, the highly conductive portion is a metal, e.g., the same metal as the layer being polished, e.g., copper.

A recess 26 is formed in the platen 24, and a thin section 36 can be formed in the polishing pad 30 overlying the recess 26. The recess 26 and thin pad section 36 can be positioned such that regardless of the translational position of the carrier head they pass beneath substrate 10 during a portion of the platen rotation. Assuming that the polishing pad 30 is a two-layer pad, the thin pad section 36 can be constructed by removing a portion of the backing layer 32.

The polishing station 22 can include a pad conditioner apparatus with a conditioning disk 31 to maintain the condition of the polishing pad.

An in-situ monitoring system 40 generates a time-varying sequence of values that depend on the thickness of an outermost layer on the substrate 10. In particular, the in-situ monitoring system 40 can be an eddy current monitoring system. Similar eddy current monitoring systems are described in U.S. Pat. Nos. 6,924,641, 7,112,960 and 7,016,795, the entire disclosures of which are incorporated herein by reference. In operation, the polishing station 22 uses the monitoring system 40 to determine when the bulk of the outermost layer has been removed and/or an underlying stop layer has been exposed. The in-situ monitoring system 40 can be used to determine the amount of material removed from the surface of the substrate.

In some implementations, the polishing station 22 includes a temperature sensor 64 to monitor a temperature in the polishing station or a component of/in the polishing station. Although illustrated in FIG. 1 as positioned to monitor the temperature of the polishing pad 30 and/or slurry 38 on the pad 30, the temperature sensor 64 could be positioned inside the carrier head to measure the temperature of the substrate 10. The temperature sensor can be in direct contact (i.e., a contacting sensor) with the polishing pad or the outermost layer of the substrate 10, which can be a conductive layer, to accurately monitor the temperature of the polishing pad or the outmost layer of the substrate. The temperature sensor can also be a non-contacting sensor (e.g., an infrared sensor). In some implementations, multiple temperature sensors are included in the polishing station 22, e.g., to measure temperatures of different components of/in the polishing station. The temperature(s) can be measured in real time, e.g., periodically and/or in association with the real-time measurements made by the eddy current system. The monitored temperature(s) can be used in adjusting the eddy current measurements in-situ.

In some implementations, a polishing apparatus includes additional polishing stations. For example, a polishing apparatus can include two or three polishing stations. For example, the polishing apparatus can include a first polishing station with a first eddy current monitoring system and a second polishing station with a second eddy current monitoring system.

For example, in operation, bulk polishing of the conductive layer on the substrate can be performed at the first polishing station, and polishing can be halted when a target thickness of the conductive layer remains on the substrate. The substrate is then transferred to the second polishing station, and the substrate can be polished until an underlying layer, e.g., a patterned dielectric layer.

Figure 2:
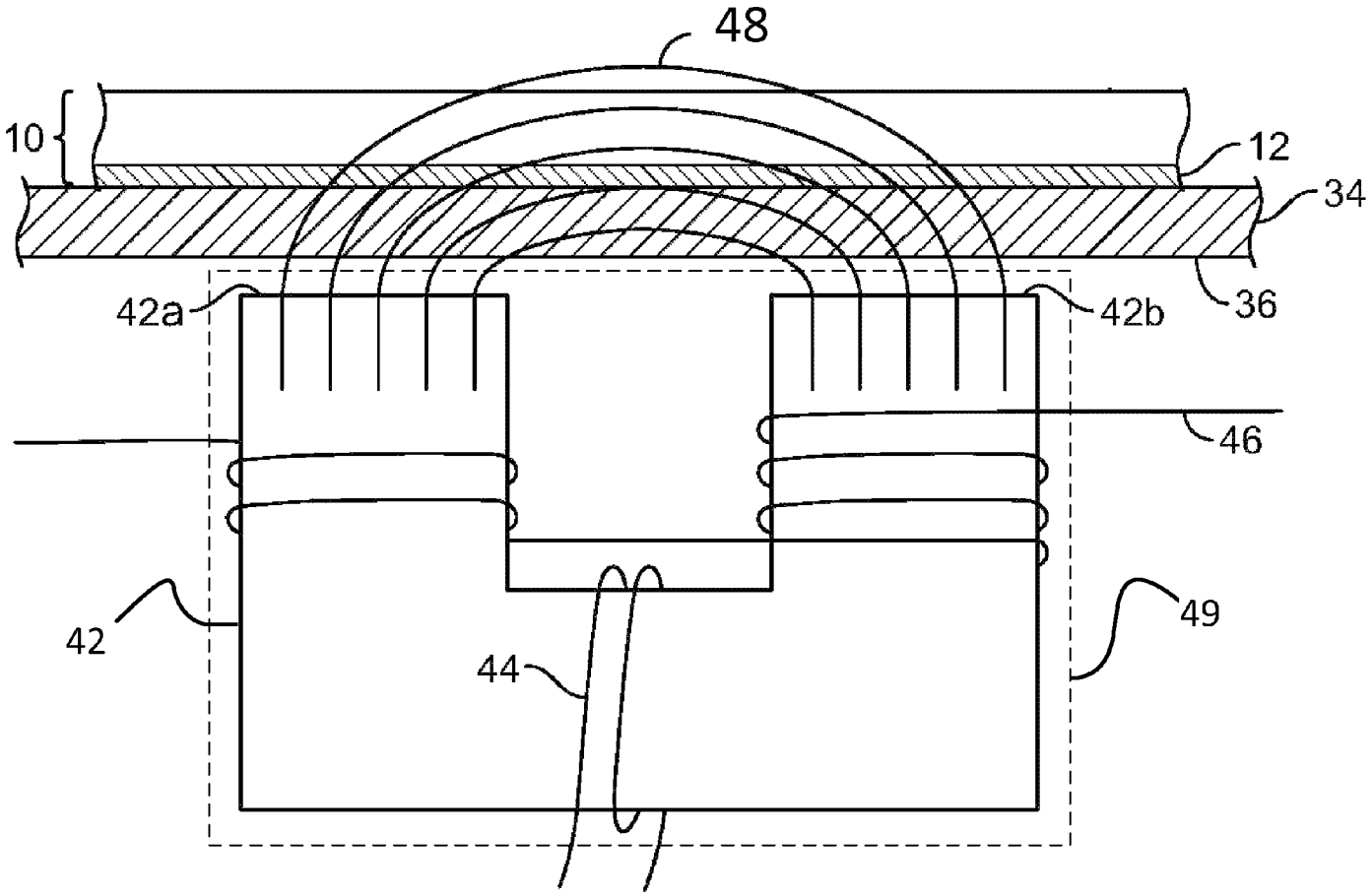
FIG. 2 illustrates a cross-sectional view of an example magnetic field generated by eddy current sensor.

FIG. 2 illustrates a cross sectional view of an example magnetic field 48 generated by an eddy current sensor 49. The eddy current sensor 49 can be positioned at least partially in the recess 26 (see FIG. 1). In some implementations, the eddy current sensor 49 includes a core 42 having two poles 42*a* and 42*b* and a drive coil 44. The magnetic core 42 can receive an AC current in the drive coil 44 and can generate a magnetic field 48 between the poles 42*a* and 42*b*. The generated magnetic field 48 can extend through the thin pad section 36 and into the substrate 10. A sense coil 46 generates a signal that depends on the eddy current induced in a conductive layer 12 of the substrate 10.

Figure 3:
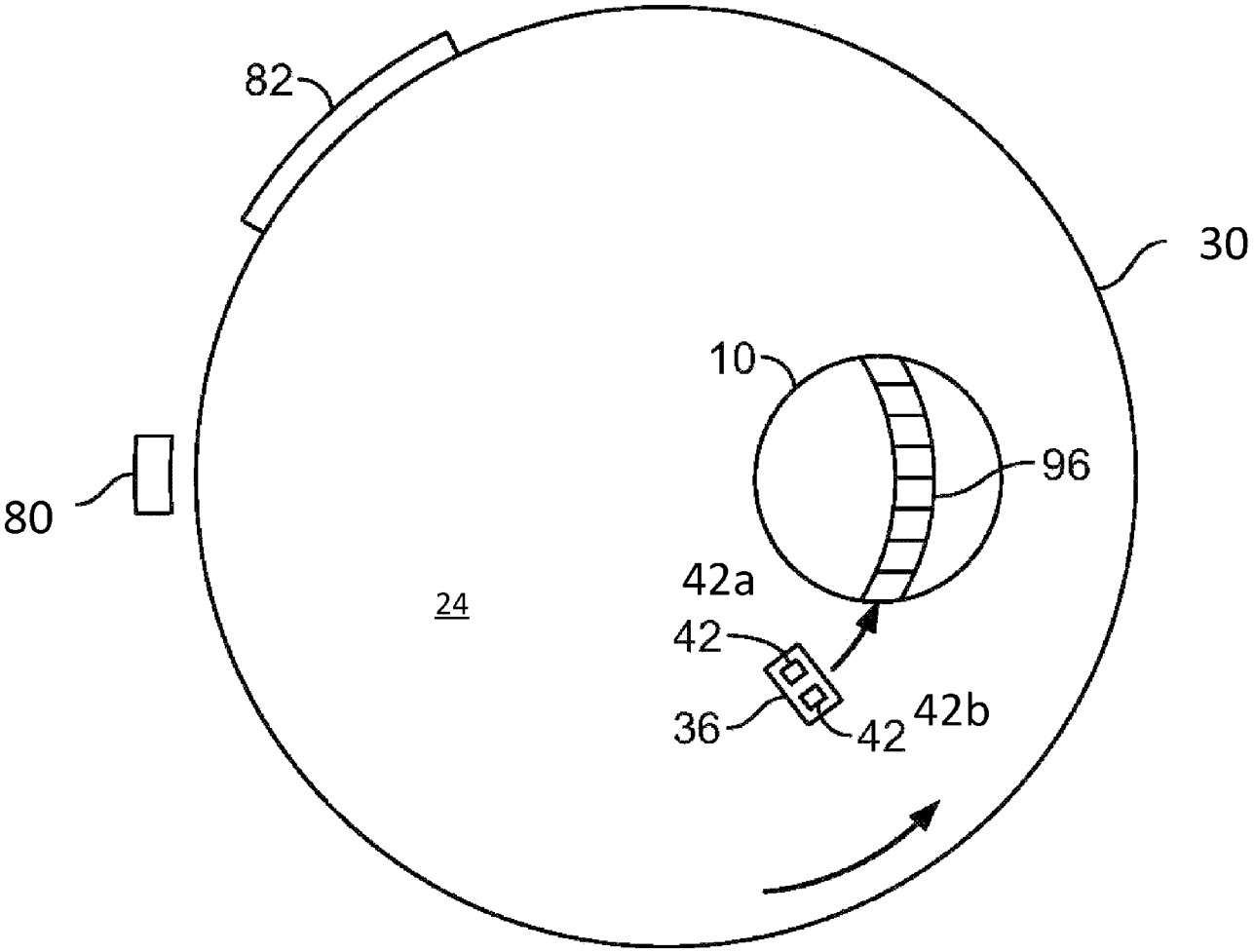
FIG. 3 illustrates a top view of an example chemical mechanical polishing station showing a path of a sensor scan across a wafer.

FIG. 3 illustrates a top view of the platen 24. As the platen 24 rotates, the sensor 49 sweeps below the substrate 10. By sampling the signal from the sensor at a particular frequency, the sensor 49 generates measurements at a sequence of sampling zones 96 across the substrate 10. For each sweep, measurements at one or more of the sampling zones 96 can be selected or combined. Thus, over multiple sweeps, the selected or combined measurements provide the time-varying sequence of values. In addition, off-wafer measurements may be performed at the locations where the sensor 49 is not positioned under the substrate 10.

The polishing station 22 can also include a position sensor 80, such as an optical interrupter, to sense when the eddy current sensor 49 is underneath the substrate 10 and when the eddy current sensor 49 is off the substrate. For example, the position sensor 80 can be mounted at a fixed location opposite the carrier head 70. A flag 82 can be attached to the periphery of the platen 24. The point of attachment and length of the flag 82 is selected so that it can signal the position sensor 80 when the core 42 sweeps underneath the substrate 10.

Alternately, the polishing station 22 can include an encoder to determine the angular position of the platen 24. The eddy current sensor can sweep underneath the substrate with each rotation of the platen.

Referring back to FIGS. 1 and 2, in operation, an oscillator 50 is coupled to the drive coil 44 and controls the drive coil 44 to generate an oscillating magnetic field 48 that extends through the body of the core 42 and into the gap between the two magnetic poles 42*a* and 42*b* of the core 42. At least a portion of magnetic field 48 extends through the thin pad section 36 of the polishing pad 30 and into substrate 10.

If a conductive layer 12, e.g., a metal layer, is present on the substrate 10, the oscillating magnetic field 48 can generate eddy currents in the conductive layer. The generated eddy currents can be detected by the sense coil 46.

As the polishing progresses, material is removed from the conductive layer 12, making the conductive layer 12 thinner and thus increasing the resistance of the conductive layer 12. Therefore, the eddy current induced in the layer 12 changes as the polishing progresses. Consequently, the signal from the eddy current sensor changes as the conductive layer 12 is polished.

Figure 4:
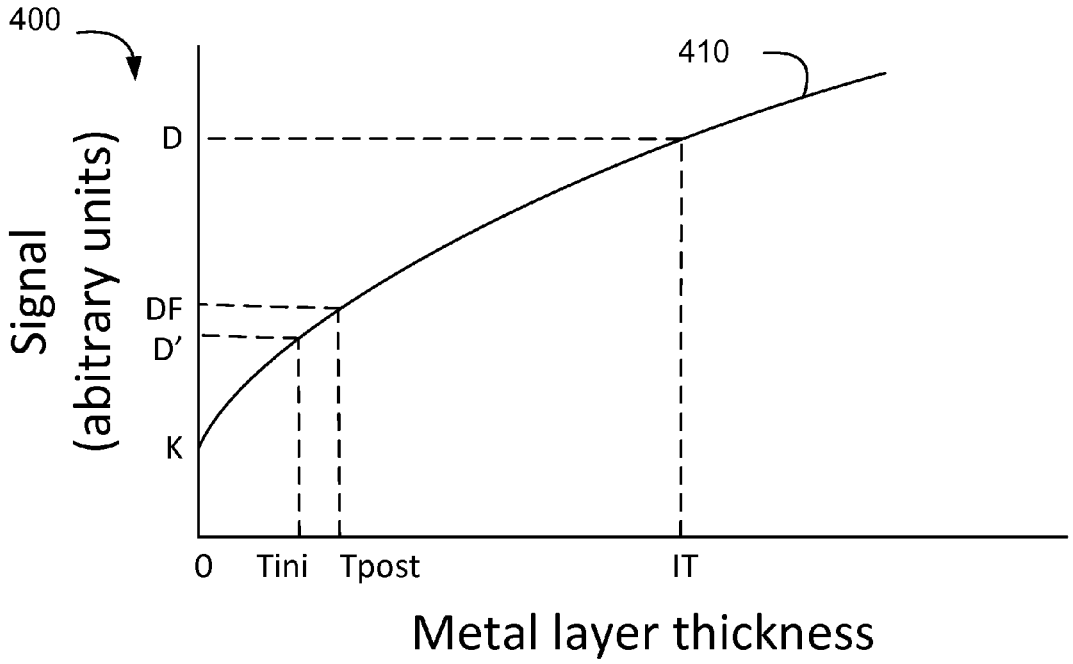
FIG. 4 illustrates a graph of an example eddy current phase signal as a function of conductive layer thickness.

FIG. 4 shows a graph 400 that illustrates a relationship curve 410 between the thickness of the conductive layer and the signal from the eddy current monitoring system 40. In the graph 400, IT represents the initial thickness of the conductive layer, D is the desired eddy current value corresponding to the initial thickness IT; $T_{post}$ represents the final thickness of the conductive layer, and DF is the desired eddy current value correspond to the final thickness; and K is a constant representing a value of the eddy current signal for zero conductive layer thickness.

In some implementations, the eddy current monitoring system 40 outputs a signal that is proportional to the amplitude of the current flowing in the sense coil 46. In some implementations, the eddy current monitoring system 40 outputs a signal that is proportional to the phase difference between the current flowing in the drive coil 44 and the current flowing in the sense coil 46.

In addition to the reduction in layer thickness, the increase in temperature of the layer with the progress of the polishing results in an increase in the resistance of the conductive layer. Thus, the eddy current induced in the layer 12 having a given thickness decreases as the temperature of the layer 12 increases. Accordingly, a measured thickness determined based on the eddy current can become smaller than an actual thickness as the temperature of the layer increases. In other words, as the temperature of a layer having the given thickness rises, the layer appears to be thinner. An endpoint determined based on such measured thicknesses may lead to the layer being under polished, as the polishing process may stop at an actual thickness larger than the measured thickness. In addition, the temperatures of conductive layers of different substrates may be different. As a result, the measured thicknesses for these conductive layers may be different and endpoints determined based on the measurements may lead to non-uniform polishing among different substrates. The measured thickness determined based on the eddy current signal can be adjusted to be closer to the actual thickness, e.g., by compensating the eddy current signal for the temperature variation of the conductive layer, and/or by compensating the measured thickness for the temperature variation of the conductive layer.

Figure 5:
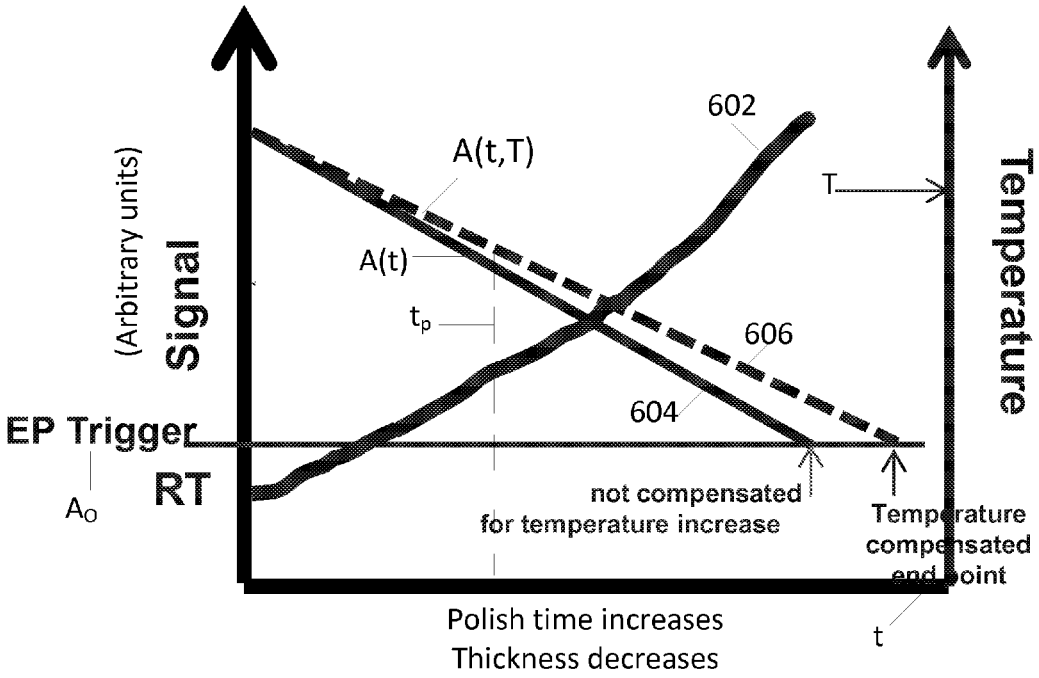
FIG. 5 illustrates a graph showing example relationships among eddy current signals, conductive layer thicknesses, polishing time, and conductive layer temperatures.

As an example, FIG. 5 shows the relationships among the conductive layer thickness, the polishing time, the strength of the eddy current signal, and the temperature variation of the conductive layer. As shown by a curve 602, the temperature T of the conductive layer increases as the polishing time t increases. Two curves 604, 606 show that the value of the eddy current signal decreases as the polishing time t increases and as the conductive layer thickness decreases. The trend of the curves 604, 606 generally corresponds to signal-conductive layer thickness relationship shown in the curve 410 of FIG. 4. However, the value of the eddy current signal A(t) decreases at a higher rate in the curve 604 where the conductive layer temperature increase in the curve 602 is not compensated than the eddy current signal A(t, T) in the curve 606 where the temperature increase is compensated. At any given polishing moment $t_p$, the value of the uncompensated eddy current signal $A(t_p)$ is no greater, e.g., smaller, than the strength of the compensated eddy current signal $A(t_p, T)$. Therefore, the measured thickness based on $A(t_p)$ is smaller than the measured thickness based on $A(t_p, T)$, which better represents the actual thickness of the conductive layer at time $t_p$.

In some implementations, an endpoint for a polishing process is triggered when the strength of the eddy current signal reaches a predetermined trigger value $A_0$, which corresponds to a predetermined conductive layer thickness. Generally, this predetermined conductive layer thickness is converted to the signal value $A_0$ under the assumption of room temperature, i.e., 20° C. Due to the actual temperature variation, the curve 604 reaches the trigger value earlier than the curve 606, leading to an early termination of the polishing process. Therefore, the conductive layer may be under polished if the curve 604 is followed. The conductive layer can be more accurately and more reliably polished if the curve 606 is followed.

Returning back to FIGS. 1 and 3, a general purpose programmable digital computer 90 can be connected to a sensing circuitry 94 that can receive the eddy current signals. The computer 90 can be programmed to sample the eddy current signal when the substrate generally overlies the eddy current sensor 49, to store the sampled signals, and to apply the endpoint detection logic to the stored signals and detect a polishing endpoint and/or to calculate adjustments to the polishing parameters, e.g., changes to the pressure applied by the carrier head, to improve polishing uniformity. Possible endpoint criteria for the detector logic include local minima or maxima, changes in slope, threshold values in amplitude or slope, or combinations thereof.

Components of the eddy current monitoring system other than the coils and core, e.g., the oscillator 50 and sensing circuitry 94, can be located apart from the platen 24, and can be coupled to the components in the platen through a rotary electrical union 29, or can be installed in the platen and communicate with the computer 90 outside the platen through the rotary electrical union 29.

In addition, the computer 90 can also be programmed to measure the eddy current signal from each sweep of the eddy current sensor 49 underneath the substrate at a sampling frequency to generate a sequence of measurements for a plurality of sampling zones 96, to calculate the radial position of each sampling zone, to divide the amplitude measurements into a plurality of radial ranges, and to use the measurements from one or more radial ranges to determine the polishing endpoint and/or to calculate adjustments to the polishing parameter.

Since the eddy current sensor 49 sweeps underneath the substrate 10 with each rotation of the platen, information on the conductive layer thickness is being accumulated in-situ and on a continuous real-time basis. During polishing, the measurements from the eddy current sensor 49 can be displayed on an output device 92 to permit an operator of the polishing station 22 to visually monitor the progress of the polishing operation. By arranging the measurements into radial ranges, the data on the conductive film thickness of each radial range can be fed into a controller (e.g., the computer 90) to adjust the polishing pressure profile applied by a carrier head.

In some implementations, the controller may use the eddy current signals to trigger a change in polishing parameters. For example, the controller may change the slurry composition.

Compensating for the Temperature Variations

As stated above, due to the temperature variation of the conductive layer, the eddy current measurements, including the endpoint thickness measured based on the received eddy current signal, may need adjustment to reflect the actual thickness of the conductive layer. The adjustment can be done by compensating the received eddy current signal A(t) for the temperature variation of the to an adjusted signal A(t, T) based on the conductive layer temperature T. Alternatively, the measured thickness determined based on the unadjusted eddy current signal A(t) can be adjusted. In some implementations, both the eddy current A(t) and the measured thickness are adjusted to determine an endpoint of a polishing process. The adjustment(s) can be automatically made in-situ by one or more computer programs stored on the computer 90 or a different computer. The in-situ adjustment can be made based on in-situ measurements of the conductive layer temperature or the polishing pad temperature and the eddy current signals. In some implementations, a user can interact with the computer programs to determine the thickness adjustment through a user interface, e.g., a graphical user interface displayed on the output device 92 or a different device.

Figure 6:
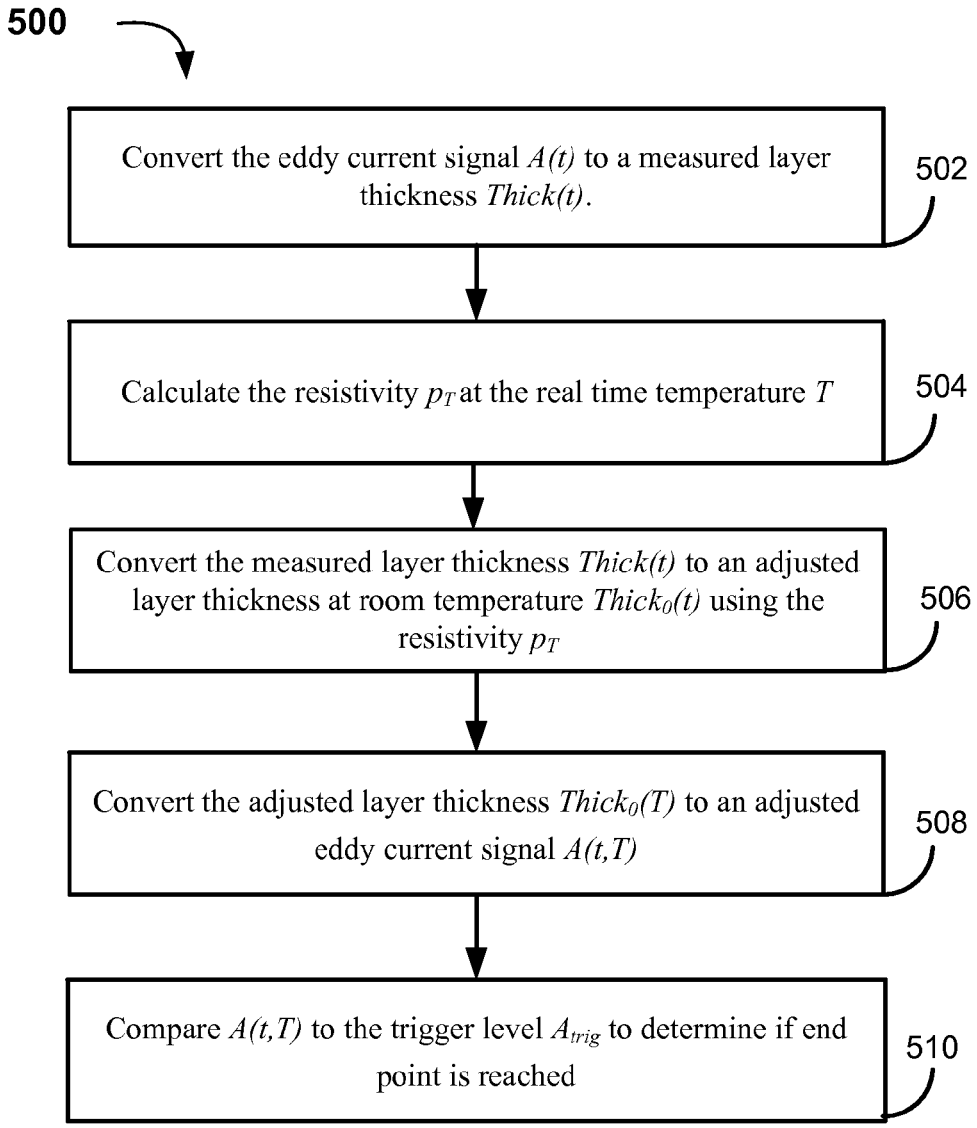
FIG. 6 is a flow graph showing an example process of compensating eddy current measurements for temperature variations of the conductive layer.

FIG. 6 shows an example process 500 of compensating the eddy current measurements, including the eddy current signal and the conductive layer thickness, for the conductive layer temperature variation. The result of the compensating process can be used in determining an endpoint for a polishing process. The process 500 can be carried out by one or more processors, such as the computer 90.

In the process 500, an eddy current signal A(t) measured at time t is converted (502) to a measured conductive layer thickness Thick(t). The conversion can be performed using a signal to thickness correlation equation of a sensor that detects the eddy current signal. The equation can be empirically determined for the sensor or type of sensor in the polishing station and for the material of the conductive layer. Once determined, the equation can be used with the sensor or type of sensor in the same polishing station for the same conductive layer material. In the example of copper layer with an Eddy current sensor, the signal to thickness correlation equation is:

$$A(t)=W_1\text{thick}(t)^2+W_2\text{thick}(t)+W_3,$$

where $W_1$, $W_2$, and $W_3$ are real value parameters.

The processor(s) carrying out the process 500 also calculates (504) resistivity $\rho_T$ of the conductive layer at the real time temperature T(t). In some implementations, the resistivity $\rho_T$ is calculated based on the following equation:

$$\rho_T=\rho_0[1+\alpha(T(t)-T_{ini})],$$

where $T_{ini}$ is the initial temperature of the conductive layer when the polishing process starts. In situations where the polishing process is carried out under room temperature, $T_{ini}$ can take the approximate value of 20° C. $\rho_0$ is the resistivity of the conductive layer at $T_{ini}$, which can be room temperature. Typically, $\alpha$ is a known value that can be found in literature or can be obtained from experiment.

An example process 700 for determining $\alpha$ is described as follows in connection with FIG. 7. The process 700 can be arrayed out as an experiment using the polishing station 22. Initially, a set of conductive layers with various thicknesses is prepared (702). Then for each conductive layer, thickness measurements are made at multiple different temperatures (704), without changing the conductive layer thickness, e.g., by heating the conductive layer over time while recording a series of thickness measurements. For each conductive layer, the varying temperatures can be measured (706) in real time using a sensor. The thicknesses of each conductive layer at the different temperatures are also measured (708), e.g., using the eddy current monitoring system 40. When the measured thicknesses are plotted versus the temperatures for each conductive layer, a slope can be determined (710) from the plot for the conductive layer. The slopes of different conductive layers can be plotted (712) versus the actual thicknesses of the different conductive layers, and a can be determined (714) as the slope of the plot made in step 712.

Referring back to FIG. 6, in the process 500, the measured conductive layer thickness Thick(t) is converted (506) to an adjusted conductive layer thickness, $\text{Thick}_0(t)$, at a standard temperature $T_{ini}$, e.g., room temperature based on the resistivity $\rho_T$. For example, the adjusted conductive layer thickness, $\text{Thick}_0(t)$, can be calculated as $$\text{Thick}_0(t)=\text{Thick}(t)\times\rho_T/\rho_0.$$

The adjusted conductive layer thickness is then converted (508) to a corresponding adjusted eddy current signal A(t, T). The conversion of the conductive layer thickness $\text{Thick}_0$ (t) to the corresponding adjusted eddy current signal A(t, T) can use the same thickness correlation equation used to convert the eddy current signal A(t) to the measured conductive layer thickness Thick(t).

Instead of A(t), the processor compares (510) A(t, T) with the end point trigger level $A_0$ of the eddy current signal to determine if the polishing process has reached an endpoint. The determination made in step 510 can be more accurate than a determination made using A(t). Under-polishing of the conductive layer can be reduced or avoided.

In some implementations, the temperatures T and $T_{ini}$ used in adjusting the measured eddy current signal and measured conductive layer thickness can be the temperatures of the polishing pad $T^p$ and $T^p_{ini}$, instead of the temperatures of the conductive layer. In some implementations, the temperatures $T^p$ and $T^p_{ini}$ can be more readily obtained in-situ than the temperatures of the conductive layer, and can be used in determining $\rho_T$ and $\alpha$ for the conductive layer with good precision. In particular, $\rho_T$ for the conductive layer can be calculated as:

$$\rho_T=\rho_0[1+\alpha(T^p(t)-T^p_{ini})],$$

where $\rho_0$ is the resistivity of the conductive layer at room temperature, and $\alpha$ is the resistivity temperature coefficient of the conductive layer.

Figure 7:
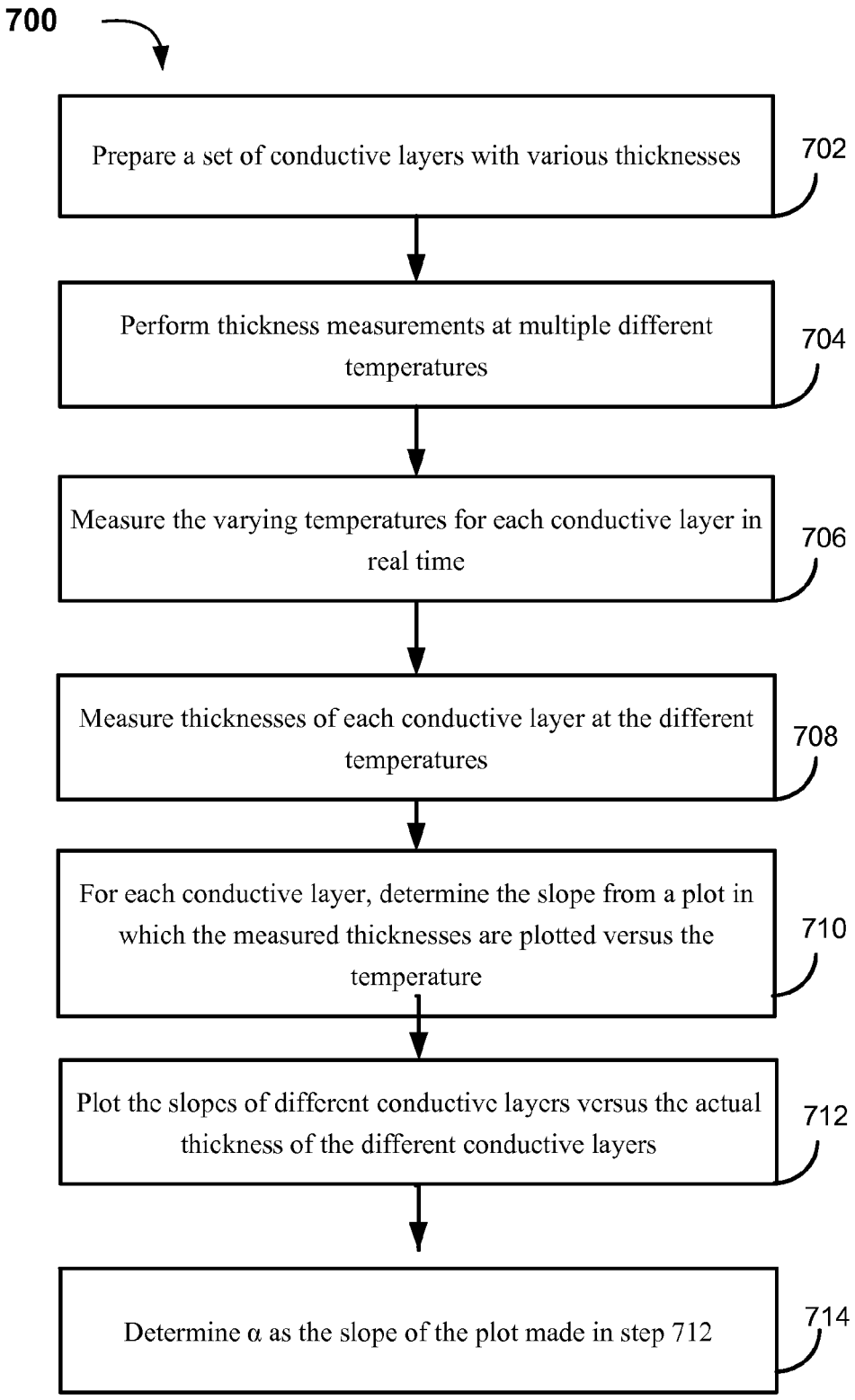
FIG. 7 is a flow graph showing an example process of determining resistivity temperature coefficient $\alpha$ of the conductive layer.

To use the temperatures $T^p$ and $T^p_{ini}$ in calculating $\alpha$ for the conductive layer, a process similar to the process 700 of FIG. 7 can be implemented. For example, except for the steps 704 and 706 of the process 700, the other steps can be carried out without changes. In a modified step 704, the temperature variation in the conductive layer is created by creating a temperature variation in the polishing pad. The pad is brought in contact with the conductive layer to change the temperature of the conductive layer without removing any material from the conductive layer. In a modified step 706, the varying temperatures of the pad are measured in real time using a sensor, which are used in the step 710, with the measured thicknesses of the conductive layers, for determining the slopes for different conductive layers.

Without wishing to be bound by any particular theory, it is believed that a resistivity $\rho_T$ calculated using the temperatures of the polishing pad $T^p$ and $T^p_{ini}$ is similar to a resistivity $\rho_T$ calculated using the temperatures of the conductive layer T and $T^p_{ini}$, because the temperature differences $(T^p(t)-T^p_{ini})$ and $(T(t)-T_{ini})$ are similar, and because $\alpha$ is also consistently determined using the pad temperature $T^p$.

Alternative to or in additional to using the processes of compensating for the temperature variations in endpoint determination, the processes can also be implemented in adjusting the measured thicknesses or other parameters related to the conductive layer during the polishing process.

In some situations, the measured thicknesses and/or other parameters can be used in adjusting control parameters, such as the polishing rate, during the polishing process. The adjusted thicknesses or other parameters can be more close to the actual thickness or actual parameters than the measured thickness or other parameters. Accordingly, more accurate control parameter adjustment can be made based on the adjusted thicknesses or other parameters.

The processes of compensating for the temperature variations can be implemented automatically without a user being aware of the processes taking place. In some implementations, a user interface can be provided to a user to allow the user to interact with the computer program(s) that implement the processes. For example, the user can choose whether to implement the processes and parameters associated with the processes. The user can make choices that best fit his/her need in the polishing processes by testing the choices one or more times and comparing the polishing results.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Embodiments can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers. A number of embodiments of the invention have been described. Nevertheless, it will be understood that various modifications may be made without departing from the spirit and scope of the invention. For example, more or fewer calibration parameters may be used. Additionally, calibration and/or drift compensation methods may be altered. Accordingly, other embodiments are within the scope of the following claims.

What is claimed is:

1. A method of controlling polishing during a polishing process, the method comprising:

receiving a measurement of a thickness, thick(t), at a time t of a conductive layer of a substrate undergoing a polishing process from an in-situ monitoring system;

receiving a measured temperature, T(t), associated with the conductive layer at the time t from a sensor configured to monitor a temperature of the polishing process, wherein the measured temperature T(t) is measured while the conductive layer of the substrate is undergoing polishing;

calculating a resistivity $\rho_T$ of the conductive layer at the measured temperature T(t);

adjusting the measurement of the thickness using the calculated resistivity $\rho_T$ to generate an adjusted measured thickness; and detecting a polishing endpoint or an adjustment for a polishing parameter based on the adjusted measured thickness.

2. The method of claim 1, wherein detecting the polishing endpoint comprises comparing the adjusted measured thickness with a predetermined measurement of thickness for determining whether the polishing process has reached the polishing endpoint.

3. The method of claim 1, wherein the monitoring system comprises an eddy current monitoring system and the measurement of the thickness comprises an eddy current signal A(t).

4. The method of claim 3, comprising converting the eddy current signal A(t) into a measured thickness thick(t) using a signal to thickness correlation equation.

5. The method of claim 1, wherein calculating the resistivity $\rho_T$ of the conductive layer comprises calculating the resistivity $\rho_T$ based on:

$$\rho_T=\rho_0[1+\alpha(T(t)-T_{ini})],$$

where $T_{ini}$ is an initial temperature of the conductive layer when the polishing process starts, $\rho_0$ is the resistivity of the conductive layer at $T_{ini}$, and $\alpha$ is a resistivity temperature coefficient of the conductive layer.

6. The method of claim 5, comprising determining the measured thickness, thick(t), at the temperature T(t) based on the measurement of the thickness and adjusting the measured thickness to an adjusted thickness $thick_0(t)$ at $T_{ini}$ using the calculated $\rho_T$.

7. The method of claim 6, wherein $T_{ini}$ is room temperature.

8. The method of claim 6, wherein adjusting the measurement of the thickness comprises converting the adjusted thickness $thick_0(t)$ to a corresponding adjusted eddy current signal.

9. The method of claim 8, wherein detecting the polishing endpoint comprises comparing the adjusted eddy current signal with a predetermined eddy current signal to determine whether the polishing process has reached the polishing endpoint.

10. The method of claim 1, wherein the measured temperature, T(t), is the temperature of the conductive layer at time t.

11. The method of claim 1, wherein the measured temperature, T(t), is the temperature of a polishing pad that polishes the conductive layer at time t.

12. A computer program product, tangibly encoded on a non-transitory computer readable media, operable to cause a data processing apparatus to perform operations comprising:

receiving a measurement of a thickness, thick(t), at a time t of a conductive layer of a substrate undergoing a polishing process from an in-situ monitoring system;

receiving a measured temperature, T(t), associated with the conductive layer at the time t from a sensor configured to monitor a temperature of the polishing process, wherein the measured temperature T(t) is measured while the conductive layer of the substrate is undergoing polishing;

calculating a resistivity $\rho_T$ of the conductive layer at the measured temperature T(t);

adjusting the measurement of the thickness using the calculated resistivity $\rho_T$ to generate an adjusted measured thickness; and detecting a polishing endpoint or an adjustment for a polishing parameter based on the adjusted measured thickness.

13. The computer program product of claim 12, wherein detecting the polishing endpoint comprises comparing the adjusted measurement of the thickness with a predetermined measurement of thickness for determining whether the polishing process has reached the polishing endpoint.

14. The computer program product of claim 12, wherein calculating the resistivity $\rho_T$ of the conductive layer comprises calculating the resistivity $\rho_T$ based on:

$$\rho_T=\rho_0[1+\alpha(T(t)-T_{ini})],$$

where $T_{ini}$ is an initial temperature of the conductive layer when the polishing process starts, $\rho_0$ is the resistivity of the conductive layer at $T_{ini}$, and $\alpha$ is a resistivity temperature coefficient of the conductive layer.

15. A polishing system, comprising:

a rotatable platen to support a polishing pad;

a carrier head to hold a substrate against the polishing pad;

a temperature sensor configured to monitor a temperature associated with the conductive layer while the conductive layer of the substrate is undergoing polishing;

an in-situ eddy current monitoring system to generate a eddy current signal depending on a thickness of a conductive layer on the substrate undergoing polishing; and a controller configured to perform operations comprising receiving a measurement of a thickness, thick(t), at a time t of the conductive layer of the substrate undergoing polishing from the in-situ eddy current monitoring system, receiving a measured temperature, T(t), associated with the conductive layer at the time t from the temperature sensor, calculating a resistivity $\rho_T$ of the conductive layer at the measured temperature T(t), adjusting the measurement of the thickness using the calculated resistivity $\rho_T$ to generate an adjusted measured thickness, and detecting a polishing endpoint or an adjustment for a polishing parameter based on the adjusted measured thickness.

16. The system of claim 15, wherein detecting the polishing endpoint comprises comparing the adjusted measurement of the thickness with a predetermined measurement of thickness for determining whether the polishing process has reached the polishing endpoint.

17. The system of claim 15, wherein calculating the resistivity $\rho_T$ of the conductive layer comprises calculating the resistivity $\rho_T$ based on:

$$\rho_T=\rho_0[1+\alpha(T(t)-T_{ini})],$$

where $T_{ini}$ is an initial temperature of the conductive layer when the polishing process starts, $\rho_0$ is the resistivity of the conductive layer at $T_{ini}$, and $\alpha$ is a resistivity temperature coefficient of the conductive layer.

18. The system of claim 15, wherein the sensor is configured to measure a temperature of the conductive layer.

19. The system of claim 15, wherein the sensor is configured to measure a temperature of the polishing pad.

* * * * *